United States Patent [19]

Fujikawa

[11] 4,387,780

[45] Jun. 14, 1983

[54] APPARATUS FOR COOLING AN ENGINE

[75] Inventor: Tetsuzo Fujikawa, Kobe, Japan

[73] Assignee: Kawasaki Jukogyo Kabushiki Kaisha, Kobe, Japan

[21] Appl. No.: 337,582

[22] Filed: Jan. 7, 1982

Related U.S. Application Data

[62] Division of Ser. No. 158,440, Jun. 11, 1980, Pat. No. 4,340,123.

[30] Foreign Application Priority Data

Jun. 13, 1979 [JP] Japan ..... 54-74899

[51] Int. Cl.[3] ..... F01P 7/02

[52] U.S. Cl. ..... 180/54 A; 123/41.59

[58] Field of Search ..... 180/54 R, 54 A, 68 R; 123/41.11, 41.12, 41.63, 41.65, 41.66, 41.58, 41.59

[56] References Cited

U.S. PATENT DOCUMENTS

| | | | |
|---|---|---|---|
| 2,917,937 | 12/1959 | Dodge | 123/41.11 X |
| 2,995,295 | 8/1961 | Day | 123/41.11 X |
| 3,203,499 | 8/1965 | Bentz et al. | 123/41.12 X |
| 3,791,482 | 2/1974 | Sykora | 180/54 A X |
| 3,872,842 | 3/1975 | Medley | 123/41.11 X |
| 4,204,486 | 5/1980 | Nakagawa et al. | 123/41.65 X |

*Primary Examiner*—Joseph F. Peters, Jr.
*Assistant Examiner*—Michael Mar
*Attorney, Agent, or Firm*—Merriam, Marshall & Bicknell

[57] ABSTRACT

Apparatus for supplying cooling air to an engine of a small vehicle wherein the engine includes a variable speed belt drive having a rotatable drive member that is connected to be rotated by the engine drive shaft. The air supply is driven by the drive member, and includes fan blades attached to the drive member, a casing around the blades, and ducts for conveying the cooling air to the engine. The engine may be either the air-cooled or the liquid-cooled type. The drive member moves axially in response to engine speed variations, and the air supply is arranged to vary the quantity of cooling air in response to variations in the engine speed and the position of the drive member.

3 Claims, 16 Drawing Figures

APPARATUS FOR COOLING AN ENGINE

This is a division of application Ser. No. 158,440, filed June 11, 1980 now U.S. Pat. No. 4,340,123.

DISCLOSURE OF THE INVENTION

This invention relates to cooling apparatus for internal combustion engines having a belt speed converter of the type used in vehicles such as small cars, snowmobiles and power tillers, and particularly to such apparatus for use in snowmobiles.

The engine of a snowmobile is usually mounted within an engine compartment formed by a hood at the front of the vehicle and is cooled by air flowing through the compartment as the snowmobile travels. Such cooling is effective when the vehicle travels at high speeds because the cooling air is rammed through it, but tends to be insufficient during low speeds and when idling. At the same time, it is sometimes difficult to provide a small snowmobile with an effective cooling air inlet.

It is a general object of this invention to provide cooling apparatus for positively producing air flow to cool an engine of a vehicle.

It is another object of the invention to provide such apparatus for positively producing varying amounts of cooling air flow; for example, additional air flow when the vehicle is moving at a low speed or when idling, and vice versa.

Figure 1:
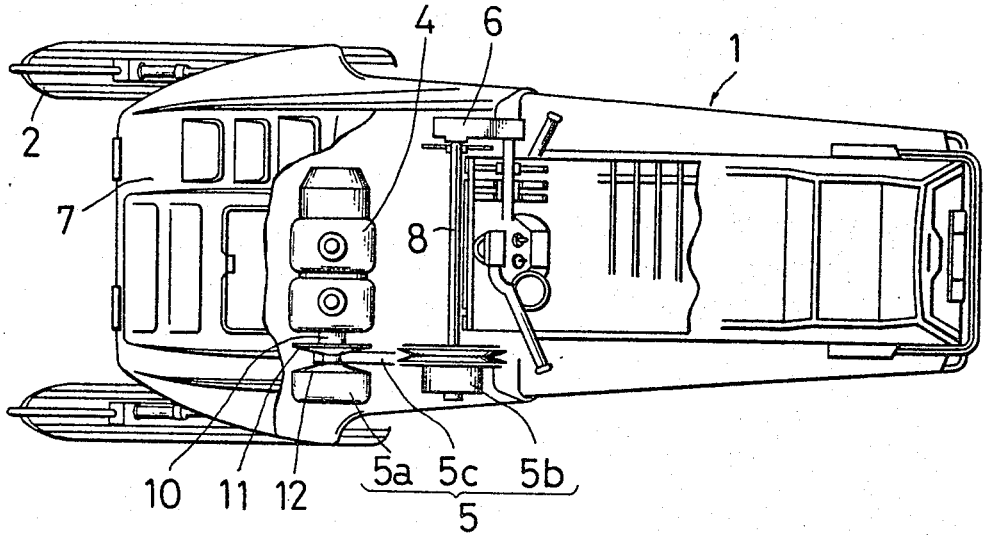
Figure 2:
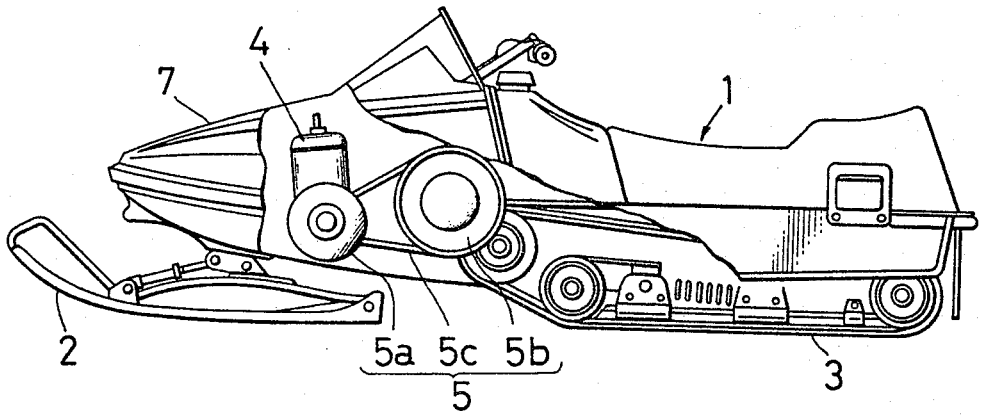
Figure 3A:
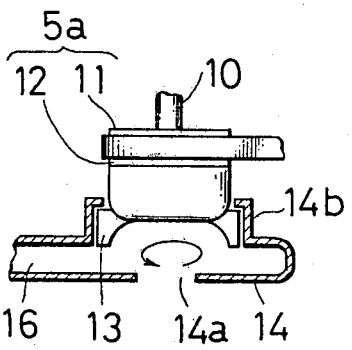
Figure 3B:
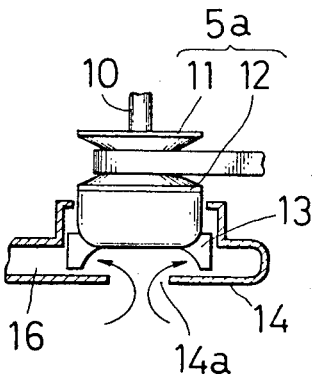
Figure 4A:
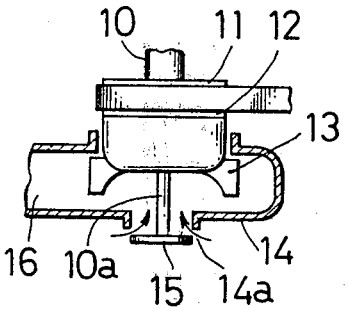
Figure 4B:
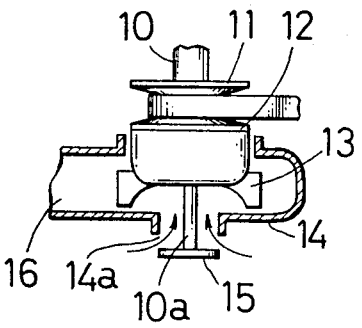
Figure 5A:
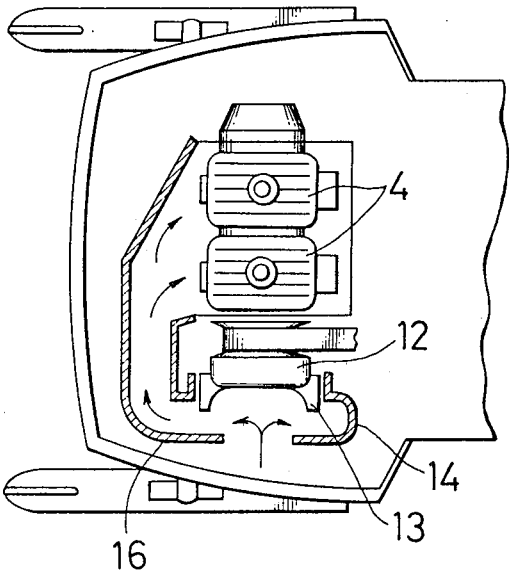
Figure 5B:
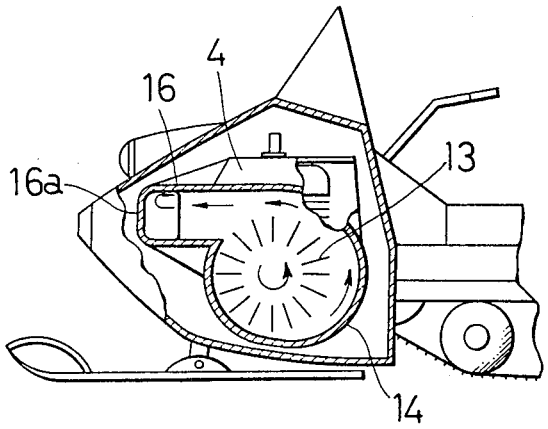
Figure 6:
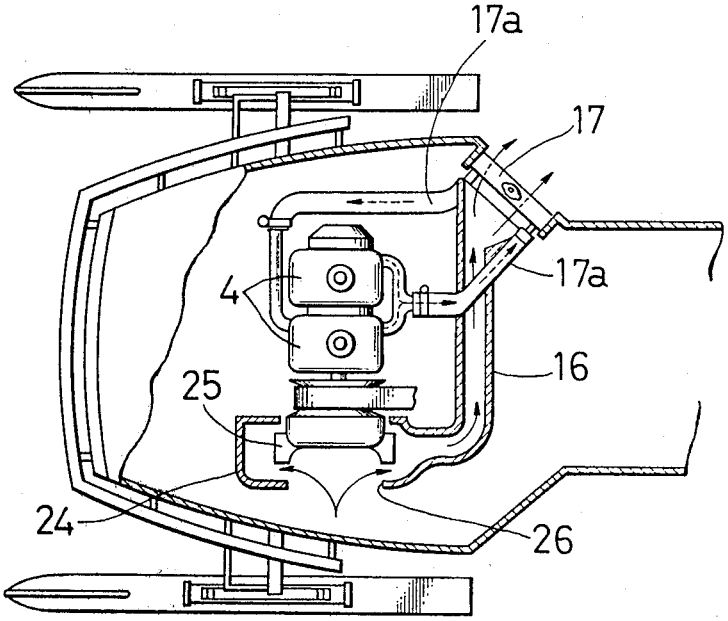
Figure 8:
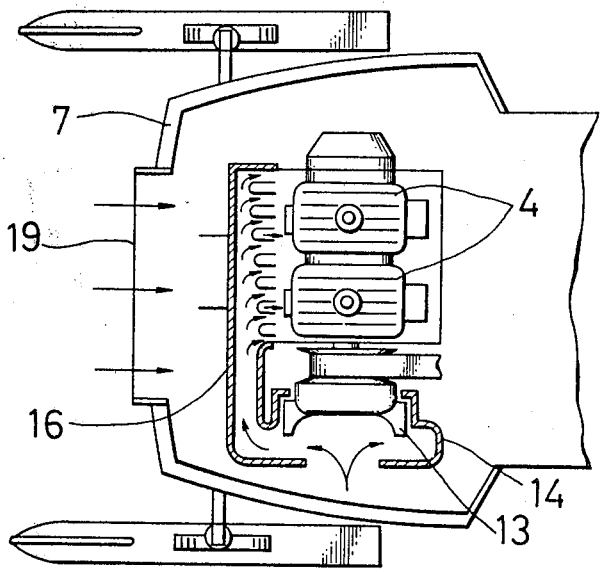
Figure 7A:
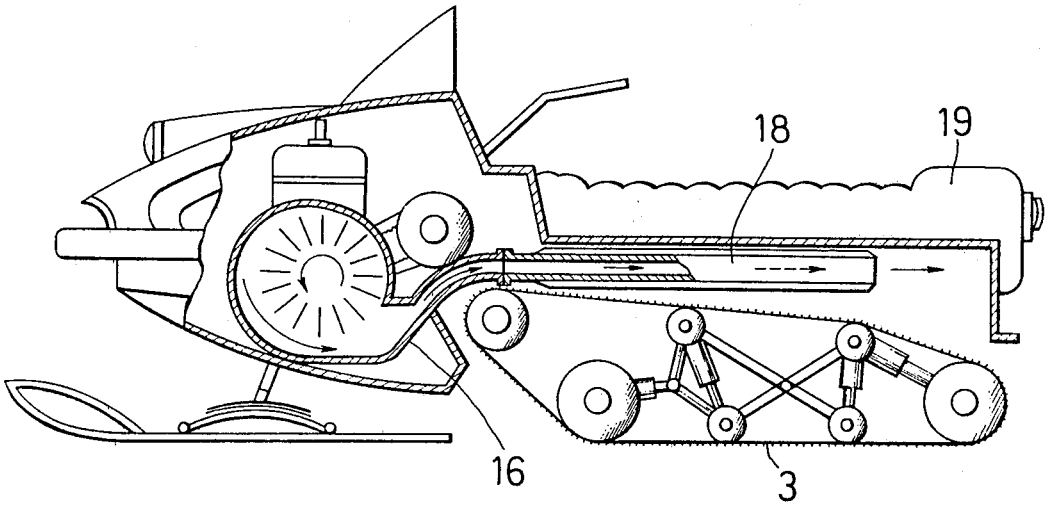
Figure 7B:
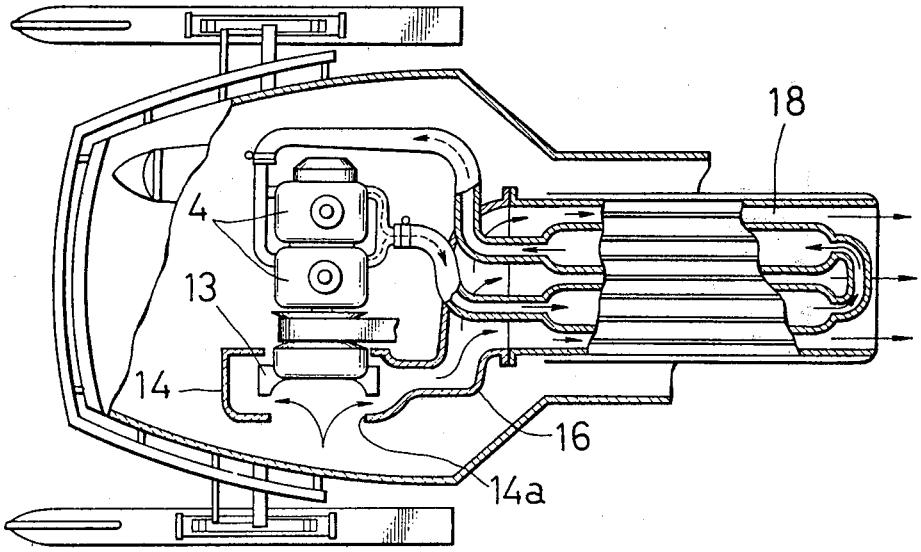
Figure 9A:
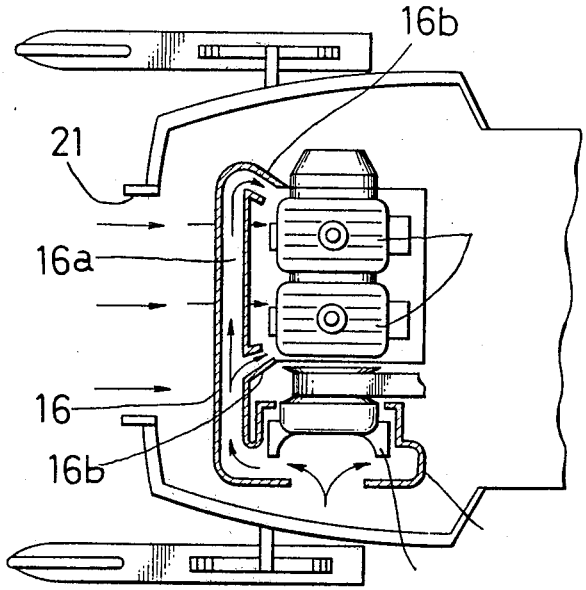
Figure 9C:
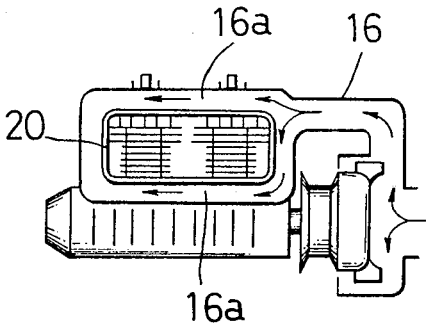
Figure 9B:
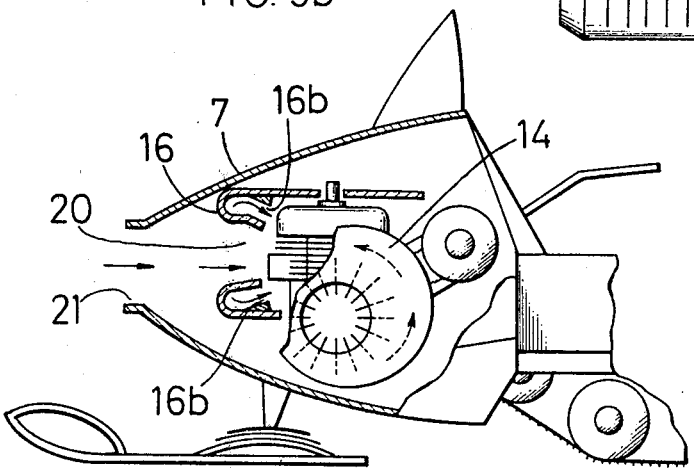
Figure 10:
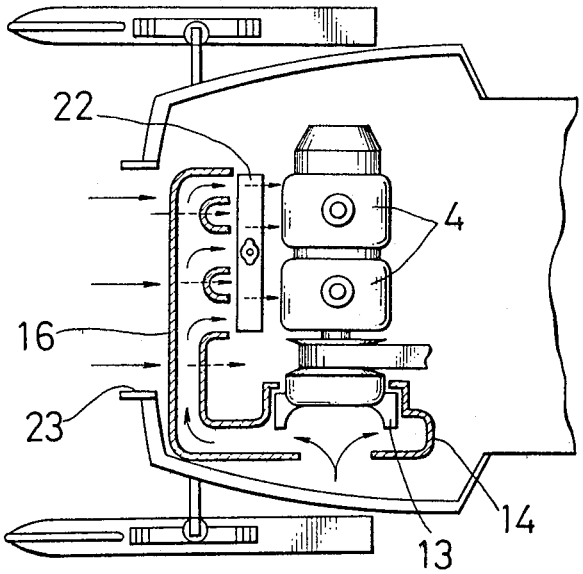

The invention will become more apparent from the following detailed description of preferred embodiments thereof taken in conjunction with the accompanying figures of the drawings, wherein:

FIGS. 1 and 2 are a top plan and a side elevational views of a snowmobile with parts broken away, to which apparatus in accordance with the invention may be applied;

FIGS. 3*a* and 3*b* are fragmentary views partially in section showing apparatus in accordance with this invention;

FIGS. 4*a* and 4*b* are views similar to 3*a* and 3*b* but showing an alternative form of the invention;

FIGS. 5*a* and 5*b* are fragmentary top plan and fragmentary side views, respectively, partially in section, showing apparatus for directing cooling air;

FIGS. 6 and 8 are fragmentary top plan views partially in section showing alternative apparatus for directing cooling air;

FIGS. 7*a* and 7*b* are a side and a top plan views partially in section showing alternative apparatus for directing cooling air;

FIGS. 9*a*, 9*b* and 9*c* are fragmentary views, partially in section, showing still another embodiment of the invention; and FIG. 10 is a top plan view partially in section of still another embodiment of the invention.

To enhance understanding of this invention, FIGS. 1 and 2 show a complete small snowmobile 1 having a pair of runners 2 at the front end and a caterpillar or moving track drive system 3 driven by an engine 4 that is mounted under a hood 7 that forms the engine compartment. The engine 4 drives the system 3 through a belt speed converter or stepless transmission 5 and a reduction gear box 6. The transmission 5 includes a driving clutch 5*a*, a driven clutch 5*b* and a V-belt 5*c* interconnecting the two clutches in driving relation. Intake air vents for cooling the engine 4 may be formed in the hood 7 or other convenient locations in the body of the vehicle.

The driving clutch 5*a* includes a fixed sheave 11 secured to an output drive shaft 10 of the engine and a movable sheave 12 rotatable with the fixed sheave 11 and movable toward and away from it. The driven clutch 5*b* also has a fixed sheave secured to a driven shaft 8 and a movable sheave. The gear box 6 is connected to be driven by the shaft 8 and the box 6 output drives the system 3. The V-belt 5*c* passes through the V-shaped annular space between the oppositely facing sheaves of each clutch. The movable sheave 12 of the driving clutch 5*a* is biased to move closely toward the fixed sheave 11 as shown in FIG. 3*a* and FIG. 4*a* as the rotational speed of the engine increases, and the belt 5*c* tends to move around the clutch 5*a* at a greater radius due to centrifugal force, while the belt moves around the driven clutch 5*b* with a smaller radius. As the engine rotational speed decreases and the belt 5*a* tends to move around the sheave 5*a* at a smaller radius, the movable sheave 12 then moves away from the fixed sheave 11 against the biasing force as shown in FIGS. 3*b* and 4*b*. The foregoing described construction and operation of the clutches 5*a* and 5*b* are well known to those skilled in this art.

According to this invention, a variable cooling air supply is also driven by the shaft 10. The movable sheave 12 of the driving clutch 5*a* has blades 13 (FIGS. 3*a* and 3*b*) forming a fan provides thereon, the blades being surrounded by a casing 14 formed with an air inlet opening 14*a* and an air outlet duct 16 preferably extending from a peripheral wall thereof, as shown in FIG. 5*b*, and leading to the engine or an engine radiator.

In FIGS. 3*a* and 3*b*, the casing 14 has a section 14*b*, which extends up or is recessed toward the clutch 5*a* and is axially displaced from the duct 16. The recess 14*b* has a diameter within which the fan blades 13 can rotate close to the peripheral wall thereof, and an axial length substantially the same as that of the blades 13. In FIG. 3*a*, the movable sheave 12 has moved close to the fixed sheave 11 during high-speed rotation of the engine, and the fan blades 13 are retracted into the recess 14*b* and displaced from the duct 16, thus producing relatively little air flow to the duct 16. In the position shown in FIG. 3*b*, wherein the movable sheave 12 has been moved away from the fixed sheave 11 during low-speed engine operation, the fan 13 is moved out of the recess 14*b* of the casing and rotates within the duct 16, thus supplying a substantial amount of air flow to the duct 16.

In the arrangement shown in FIG. 4, the casing 14 and the duct 16 are widened so that the fan blades 13 always rotate within the duct. Attached to the movable sheave 12 is an axial shaft 10*a* that extends outwardly from the sheave 12 through the inlet opening 14*a* of the casing 14. The shaft 10*a* has a valve member 15 at its outer end which is adjacent the opening 14*a* and can externally choke or at least partially close the opening 14*a*. During high-speed operation of the engine (FIG. 4*a*), the valve member 15 is retracted with the movable sheave 12 and is close to and chokes or closes the inlet 14*a*, thus supplying little air flow to the duct 16. During low-speed engine operation (FIG. 4*b*), the valve member 15 is moved outwardly and opens the inlet 14*a*, allowing the fan 13 to supply a substantial air flow.

In FIG. 5, the variable air supply is similar to the arrangement shown in FIGS. 3*a* and 3*b*. The duct 16 includes spaced plates 16*a* that lead to the front side of the engine 4 to directly cool an air-cooled engine.

FIG. 6 shows the invention applied to a liquid-cooled engine. A radiator 17 is connected to engine cooling jackets by hose 17*a* and the coolant flows through the radiator 17 during engine operation. The duct 16 leads to the radiator 17 in order to cool the engine coolant.

FIGS. 7*a* and 7*b* also show a liquid-cooled engine including a radiator 18 mounted under the seat 19 and the floor of a snowmobile but over the caterpillar drive 3. The duct 16 leads to the radiator 18 and cools the radiator even though there is no snow which would be thrown up by the caterpillar drive 3 to cool it.

In FIG. 8, the duct 16 leads from the casing 14 to the front side of an air cooled engine 4 to cool the engine, which is also adapted to be cooled by ram air entering the engine compartment through a front opening 19 in the vehicle hood 7. This arrangement constitutes a combination of ram or natural air cooling and positive or fan drive air cooling.

In FIGS. 9*a*, 9*b* and 9*c*, the duct 16 includes branches 16*a* having outlets or nozzles 16*b* directed toward the engine 4 and extending in front of the engine. The ducts 16*a* form a generally rectangular configuration that has at least one central opening 20 through which air can flow from outside the engine while the positive air flow can also be supplied through the duct 16 and the nozzles 16*b*. An opening 21 in the hood 7 admits air to the engine compartment.

In the arrangement shown in FIG. 10, a radiator 22 of a liquid cooled engine 4 is mounted in front of the engine 4. The duct 16 opens to the front side of the radiator 17 so that the radiator is cooled by the fan 13 driven variable air supply. The duct 16 is also arranged so that air can pass therethrough from the outside to the radiator through a hood opening 23, so that the engine is cooled by the coolant, the variable air supply, and the ram air.

FIGS. 6 and 7 also illustrate still another variable air supply arrangement. A relatively wide fan casing 24 has no recess 14*a* that the fan 25 can be retracted into, and there is no such valve member 15 to choke the inlet opening of the casing. However, during low-speed operation of the engine, the fan 25 is adjacent to the inlet 26 of the casing 24 and can therefore supply a relatively large amount of air flow to the duct 16, and during a high-speed operation, the fan is moved inwardly away from the inlet 26, forming a free air space therebetween, which produces less air flow.

Thus, according to this invention, apparatus has been provided comprising a fan attached to the movable sheave of a variable speed driving clutch to positively produce air flow, and a duct system for directing the air flow to cool an engine or a radiator. As the rotational speed of the engine becomes higher, the movable sheave of the clutch moves to place the fan blades so as to produce less air flow, or to choke the air inlet for the fan, so that the fan produces less air flow. As a result, during high-speed engine rotation, the engine will not be loaded substantially due to the cooling by air and will thus effectively drive the vehicle.

A number of different variable air supply arrangements have been disclosed along with different duct arrangements and both air-cooled and liquid-cooled engines. It should be apparent that any of the variable air supply arrangements may be used in all of the different duct and engine constructions disclosed herein.

What is claimed is:

1. Variable air supply apparatus for cooling an engine having a belt speed converter connected to an output shaft of the engine, the converter including a fixed sheave secured to the output shaft and a movable sheave axially movable relative to said fixed sheave and rotatable therewith said movable sheave responding to changes in the engine speed and having an axial position which is related to the rotational speed of the engine, the sheaves forming a space therebetween that receives a belt, said apparatus comprising a fan adapted to be attached to said movable sheave and to produce positive air flow when said engine rotates, a casing around said fan and having an air inlet opening, an air outlet duct communicating with said casing and mounted to convey air to cool the engine, and a valve member adjacent said inlet opening and axially movable with said movable sheave to substantially close said air inlet opening of said casing as said movable sheave moves toward said fixed sheave.

2. Apparatus as in claim 1, wherein said fan is movable within said casing to thereby produce varying amounts of air flow upon movement of said movable sheave.

3. Apparatus comprising an engine having a drive shaft, a variable speed belt drive connected to rotate with said shaft, said drive including a rotatable member which is movable along its axis of rotation in response to changes in the rotational speed of said engine and said belt drive and having an axial position which is related to the rotational speed of the engine and an air supply driven by said drive and including a fan connected to rotate and to move axially with said rotatable member, a casing around said fan, said casing having an air inlet opening formed therein, and a duct connected to said casing and located to convey cooling air from said casing to said engine, said air supply responding to said axial movement of said rotatable member to deliver varying amounts of air, and said air supply including a valve member connected to said rotatable member and mounted adjacent said inlet opening for varying the amount of delivered air.

* * * * *